United States Patent [19]

Alberts

[11] 3,995,814

[45] Dec. 7, 1976

[54] IMPACT DISINTEGRATOR

[76] Inventor: Albert K. Alberts, 1084 Canyon Crest Drive, Bountiful, Utah 84010

[22] Filed: Aug. 25, 1975

[21] Appl. No.: 607,358

[52] U.S. Cl. ..... 241/5; 241/275

[51] Int. Cl.[2] ..... B02C 23/00

[58] Field of Search ..... 241/5, 18, 19, 24, 26, 241/31, 55, 79, 79.1, 275

[56] References Cited

UNITED STATES PATENTS

| | | | |
|---|---|---|---|
| 2,919,864 | 1/1960 | Parmele | 241/275 X |
| 2,992,784 | 7/1961 | Behnke et al. | 241/275 |
| 3,065,919 | 11/1962 | Burkett et al. | 241/275 |

*Primary Examiner*—Granville Y. Custer, Jr.
*Attorney, Agent, or Firm*—Mallinckrodt & Mallinckrodt

[57] ABSTRACT

An impact disintegrator for ore and rock material includes an annular grizzly for supporting an annular array of closely associated chunks of target material, which preferably are the same as the ore or rock material to be disintegrated, and a rotary slinger disposed centrally of the grizzly for forcibly slinging pieces of the ore or rock material to be disintegrated outwardly toward and against the array of chunks supported by the grizzly. The slinger is designed to also act as a blower to force air into the disintegrator. A plurality of chutes depend from beneath the grizzly for receiving disintegrated ore or rock materials resulting from the impact of the slung pieces against the array, and means may be provided for bleeding off fines from the disintegrated material received by the chutes.

12 Claims, 10 Drawing Figures

IMPACT DISINTEGRATOR

BACKGROUND OF THE INVENTION

1. Field

The invention is in the field of disintegrators for ore or rock materials, particularly autogenous disintegrators.

2. State of the Art

Present impact disintegrators sling material to be crushed against an impact surface usually of steel plate or bar construction. Upon impact, some of the impact surface is worn, introducing steel particles into the material being disintegrated. Air flow through the disintegrator is usually limited to whatever air is in the system or to whatever enters through the slinger or other openings which are not designed particularly for inducing air flow. Consequently, air-suspended particles of disintegrated material build up in the disintegrator chamber, hindering proper disintegration of additional material fed to the machine and increasing the danger of dust-generated explosions. Separation of coarse and fine fractions of the disintegrated material, if carried out at all, is usually accomplished by a

SUMMARY OF THE INVENTION

According to the invention, an impact disintegrator for ore and rock materials includes an annular grizzly for supporting an annular array of closely associated chunks of target material for impact breaking, preferably of the same ore or rock material that is to be disintegrated, and a rotary slinger disposed centrally of the grizzly for forcibly slinging pieces of the ore or rock material to be disintegrated outwardly toward and against the array of chunks supported by the grizzly. In this way, the impact surfaces which wear may be of the same material as the material to be disintegrated, thereby substantially reducing contamination.

A plurality of chutes depend from beneath the grizzly for receiving disintegrated ore or rock material resulting from impact of the slung pieces against the array, and means may be provided for bleeding off fines from the material so received. Preferably, upwardly sloping passages connect to the chutes intermediate their lengths and lead to a central, fines-collecting area. Means are provided to create a partial vacuum within the fines-collecting area and in the passages, thereby causing air flow from the chutes through the passages into the collecting area. The fines are drawn into the passages and the collecting area by such air flow, while the downward momentum of the heavier particles carry them past the passages and on down the chutes.

The rotary slinger is designed so that it is also a blower supplying air to the disintegration area. Thus, air and entrained solid particles flow vigorously through the chutes and passages, aided by reason of the partial vacuum maintained in such chutes and passages. The air flow immediately sweeps away disintegrated particles, so they cannot build up. Such air flow also maintains throughout the disintegrator a very high ratio of air to suspended particles, thereby greatly reducing the chance of explosion when flammable materials are being disintegrated.

It is preferable that rupturable sleeves be attached to the lower ends of the chutes, so, if an explosion occurs, the sleeves will rupture and result in a sudden substantial increase of the air-to-particle-ratio, thereby extinguishing any flame.

THE DRAWINGS

The invention is described with particular reference to the accompanying drawings in which is illustrated an embodiment of apparatus representing the best mode presently contemplated of carrying out the invention.

In the drawings:

FIG. 1 is a top plan view of the apparatus;

FIG. 2, a vertical, axial section taken on the line 2—2 of FIG. 1;

FIG. 3, a view similar to that of FIG. 1, but with the top cover removed;

FIG. 4, a top plan view of the slinger disc per se;

FIG. 5, a side elevation of the slinger disc taken from the standpoint of the line 5—5 in FIG. 4;

FIG. 6, a fragmentary vertical section taken on the line 6—6 of FIG. 1, showing how the top cover plate is attached;

FIG. 7, a horizontal section taken on the line 7—7 of FIG. 2;

FIG. 8, a similar section taken on the line 8—8 of FIG. 2, certain hidden portions being shown by dotted lines;

FIG. 9, a fragmentary vertical section taken on the line 9—9 of FIG. 8; and FIG. 10, a similar view taken on the line 10—10 of FIG. 8.

DETAILED DESCRIPTION OF THE ILLUSTRATED EMBODIMENT

Figure 7:
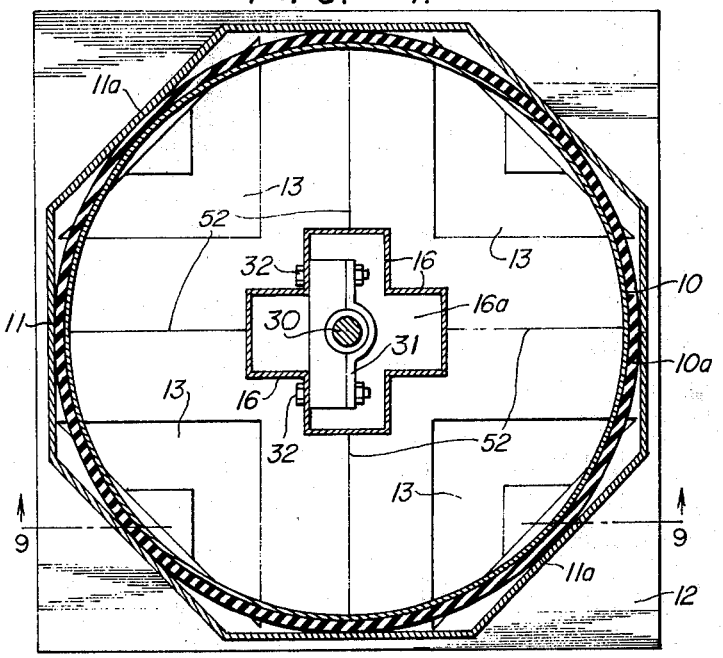
Figure 8:
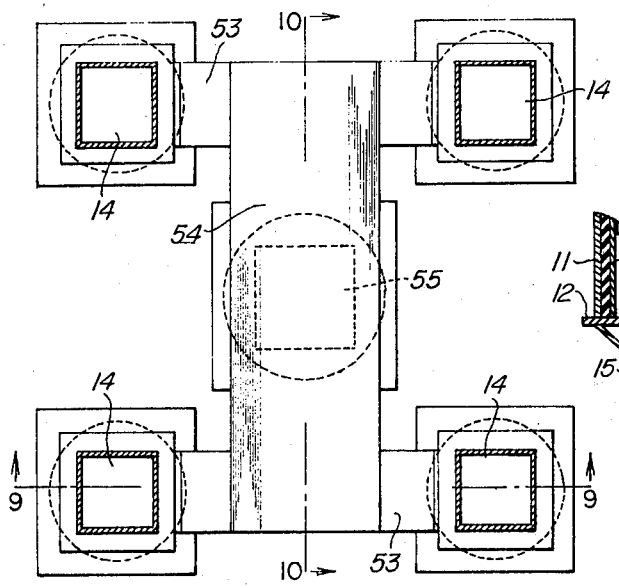
Figure 9:
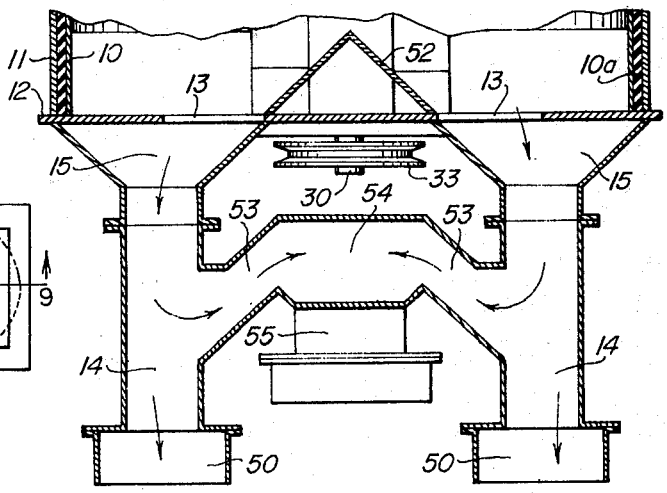
Figure 10:
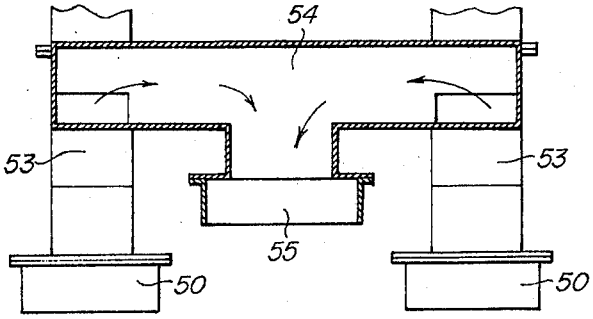

As illustrated, a disintegration chamber is formed by a circular wall 10 positioned within an octagonal wall 11. Both walls are positioned on and secured to a base plate 12, as by welding. Triangular holes 13, FIG. 7, in base plate 12, open into passageways 14, FIG. 9, through hopper-like chutes 15 located at respective corners of and beneath plate 12. Walls 16 are secured, as by welding, to plate 12 along the edges of a cross-shaped hole **16*a* and extend upwardly, in the same cruciform configuration, into the cylindrical area defined by wall 10**.

Figure 2:
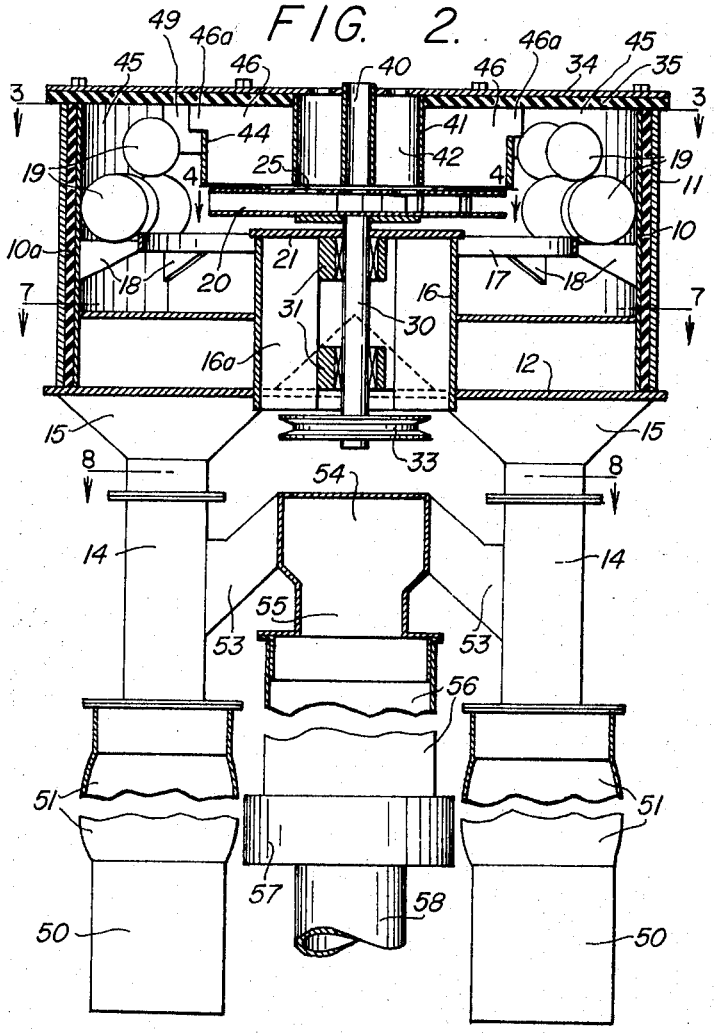
Figure 3:
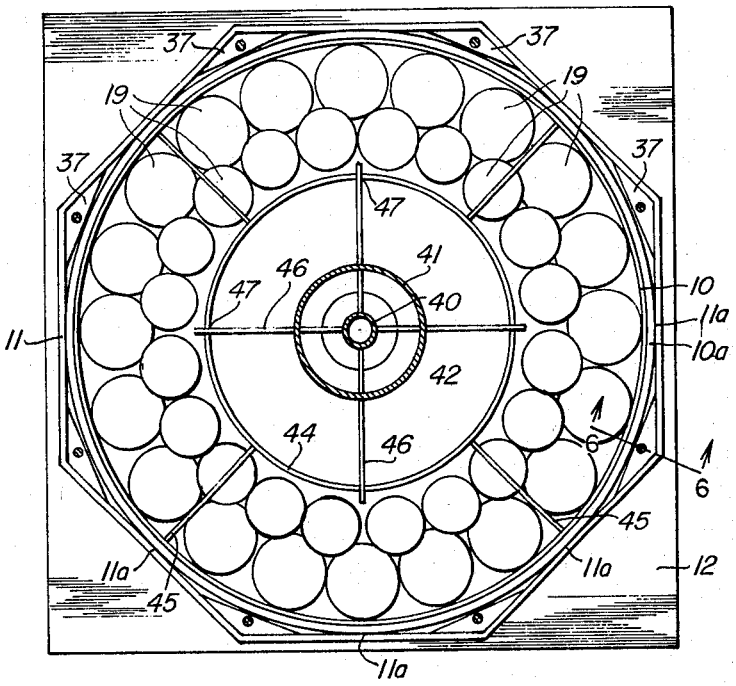

As shown in FIG. 2, an annular bar 17 supported by brackets 18 forms an annular grizzly extending inwardly from circular wall 10. Chunks 19 of target material are placed in a closely associated array upon the grizzly. The chunks of impact breaking target material are shown as spherical for ease of illustration, but they may be of any convenient size or shape which will fit into the grizzly.

A sheet of rubber or similar sound-deadening material **10*a* is located between walls 10 and 11 being preferably applied to cylindrical wall 10 as a backing, and being contacted tangentially by the facet panels, 11*a* of octagonal wall 11**.

Figure 4:
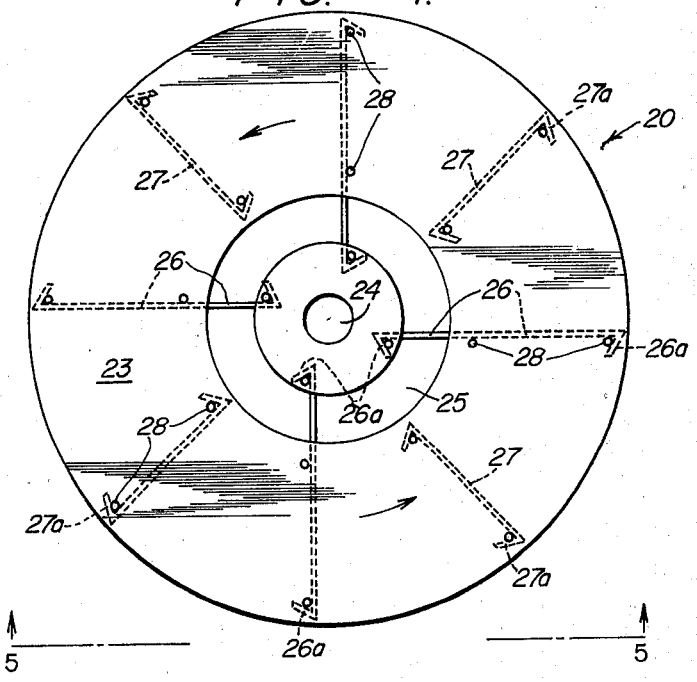

A rotary slinger 20 is disposed centrally of the grizzly and above a top plate 21 that is secured to the upper ends of walls 16 as a cover for cruciform hole **16*a*. Such slinger comprises mutually spaced lower and upper discs 22 and 23, respectively, FIG. 5, of substantially equal diameters. Upper disc 23 has a central feed opening 24, FIG. 4, and has an annular air-feed opening 25 concentric therewith. Sandwiched between the two discs are a set of vanes 26, which extend from a location between central feed opening 24 and air feed ring 25 to the periphery of the discs, and a set of vanes 27, which extend from the outside of air feed opening 25, to the periphery of the discs. The discs are secured together by bolts 28**, which also hold the vanes in place.

For this purpose, the ends of these vanes are hooked, as indicated at 26*a* and 27*a*, respectively.

Figure 5:
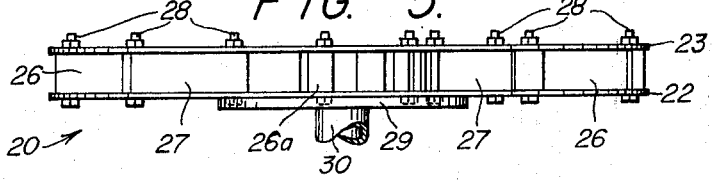

A smaller disc 29, FIG. 5, is secured to the bottom of lower slinger disc 22 by appropriate ones of the bolts 28, and is used to attach the slinger to one end of a shaft 30, as by welding. Shaft 30 extends through plate 21, see FIG. 2, and is supported and journaled by bearings 31 that are attached by bolts 32, FIG. 7, to two of the walls 16. Shaft and slinger are belt driven, from a motor (not shown), through a pulley 33 secured to the lower end of shaft 30.

In order to make the slinger easily removable for repair or replacement, the bolts 28 which secure the slinger to the disc 29 have their heads accommodated in slots in disc 29. This keeps the heads from turning as the nuts on the bolts are tightened or loosened. The clearance between the lower surface of disc 29 and the upper surface of cruciform top plate 21, is such that as the bolts are loosened the heads will drop down and rest on top plate 21 while still remaining partially in the slot in disc 29 to keep the heads from rotating.

Figure 6:
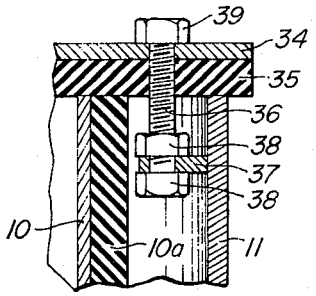

Octagonal plate 34, FIG. 2 and 6, having a backing 35 of rubber or other sound-proofing material, is secured over the disintegration chamber defined by wall 10, as a cover, by means of bolts 36 fastened to brackets 37 by nuts 38. The cover is cinched down tightly by nuts 39.

The ore or rock material to be disintegrated is preferably fed to slinger 20 by gravity through a pipe 40, and is thrown from slinger 20 with considerable force against the target material 19 supported by the grizzly, the impact causing disintegration of the relatively small pieces of thrown material and some spalling of the target material when the two are the same material.

Figure 1:
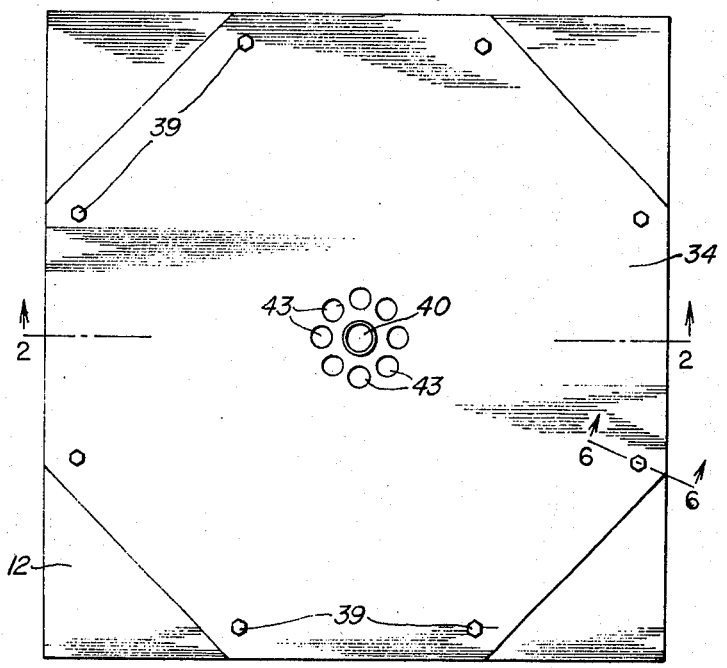

Surrounding feed pipe 40 concentrically therewith is a wall 41, FIG. 2, forming a passageway 42 for atmospheric air that is drawn in by slinger 20 (acting as a blower) through holes 43, FIG. 1, in cover plate 34 and discharged into the slinger through air feed opening 25. It should be noted that opening 25 could be a series of holes corresponding to the holes 43, if desired.

To prevent accumulation of disintegrated material on top of slinger 20, a circular wall 44 of diameter slightly larger than that of the slinger is held in position about and above such slinger by gusset plates 45 fastened, as by welding, to wall 10.

Pipe 40 and circular wall 41 are fastened together and suspended in position above slinger 20 by gusset plates 46, which fit into slots 47 extending downwardly from the upper edge of wall 44. Gusset plates 45 are notched as at 49 to accommodate the tab ends 46*a* of gusset plates 46 that fit into the slots 47. The assembly of pipe 41, wall 42, and gusset plates 46 may be lifted upwardly and removed from the apparatus after cover plate 34, with its rubber backing 35, is removed.

This feature of easy removability is important so that the slinger can be easily removed and replaced. It is the only part of the apparatus that wears quite rapidly through abrasion. The chunks of ore or rock 19 on the grizzly will, of course, require replacement from time to time. Some or all may be easily replaced as they wear away, requiring only the removal of top plate 34 with its rubber backing 35.

In the particular embodiment shown, the four chutes or passageways 14 that depend from hopper-like chutes 15 below the disintegration chamber, lead to collection means for relatively large particles. Such collection means may be nothing more than a ground or floor area on which the disintegrated material falls, but preferably comprise closed collection bins 50. When closed vessels, such as the bins 50, are used as the collection means, the discharge ends of the chutes 14 may be connected to such vessel by rupturable bags 51, respectively. Thus, if dust causes explosions, only the sleeves rupture. Alternately, rupturable plugs could be provided in chutes 14 to serve the same purpose as the bags. The collection area is preferably at least partially closed so that large quantities of air cannot enter the apparatus through the lower ends of the chutes.

To facilitate flow of disintegrated material from the disintegration chamber into hopper-like chutes 15, ridge structure 52 is provided on plate 12.

It is preferable that fines be removed from the relatively large particles of disintegrated material descending through chute 14. To this end, upwardly sloping ducts 53 are provided leading from intersecting communication with chutes 14 intermediate their lengths to a collection duct 54 having a central discharge outlet 55. Outlet 55 is preferably connected either directly or through a rupturable bag 56 to an exhaust and dust collection system including a high capacity blower 57 for the purpose of withdrawing more air than can be blown into the apparatus by the slinger. This creates a partial vacuum and consequently a large air flow within the apparatus, which substantially prevents any build up of disintegrated particles and keeps the ratio of air to particles within the apparatus high. High air flow within the disintegrator is important to insure that all disintegrated particles are immediately withdrawn from the impact area, so that slung particles will have a clear path from the slinger to the target and will not uselessly dissipate energy in collisions with other particles. The exhaust and dust-collection system may use standard equipment communicating with duct 58 leading from blower 57.

When explosive materials such as coal are being disintegrated, the high air to particle ratio is important as a safety factor to prevent explosions. With a high air to particle ratio and an air flow that maintains the high ratio throughout the disintegrator, the concentration of particles to air can usually be kept below an explosive level.

The amount of air flow in the apparatus is adjusted, as by control of blower speed, so that particles of a selected size and fines will be drawn with the air stream as fines, while larger particles will continue down chutes 14. The exhaust system may and preferably does include means (which may be conventional) for collecting the fines and for cleaning the air prior to its discharge into the atmosphere.

The size of the particles being discharged from the disintegrator may range from as large as the input material to be disintegrated, if, by chance, a particle is not disintegrated at all as it passes through the disintegrator, down to particles in the micron size range. If no fines collection system is provided, the entire range of particles will be collected in bins 50. If a fines collection system is provided, it may be adjusted over a wide range by adjusting the air flow so that all particles less than a desired size, for example, all particles less than 1/16 inch, may be recovered as fines. The size of the fines wanted will depend upon the use to which the fines are put.

If the described system for removing fines is not used, a reasonably high air flow through the apparatus can be maintained merely by the blower action of the slinger.

The speed at which the slinger rotates and the mass of the pieces thrown by it will determine the force of the disintegrating impact. Thus the optimum speed of rotation of the slinger will depend upon the desired degree of disintegration and the piece size and mass and the type of the material being disintegrated.

It has been found that, for most materials to be disintegrated, the mesh size for disintegration in one pass through the apparatus should be one half inch or less, i.e. half inch minus.

It is important for proper and complete disintegration that the particles have a substantially free path to the target, as previously indicated, and that they strike the target material within a rather narrow band. For half inch minus material, the slinger discs 22 and 23 should be spaced about three-quarters of an inch apart. This will insure that the individual pieces will not get caught while passing between the discs and will establish a substantially planar trajectory for the slung pieces. With the target material approximately 3 inches in height, the slung pieces will strike essentially within a three-quarter inch band centrally of the height of such target material. The distance from the outer periphery of the slinger to the target material should be about 2 inches. This will enable air flow to substantially clear the trajectory without unduly affecting the slung material.

It is preferred that the rock or ore material placed on the grizzly to form the impact surface be of the same material being disintegrated. This will tend to keep contamination to a minimum because part of the impact device will be worn away each time a particle strikes it. If the material worn from the impact surface is the same as the material impacting, no foreign material is introduced into the particles. Of course, if contamination causes no problems, any material may be used for the impact surfaces. In the pharmaceutical industry where material such as aspirin which may be produced in other than powder form and may thus need to be disintegrated before being made into pills, or where materials such as kaolin clay which is used as coating material or filler material in pills may need to be disintegrated into powdered form before use, the target material will generally be of a porcelain or clay material that has no effect on the material being disintegrated and has no effect on the body when ingested.

Even when the target material is the same as that being disintegrated, there will be slight contamination because of the wear of the slinger, particularly the blades thereof, but this is small compared to the contamination usually generated by the impact surfaces, and is usually of little consequence.

Whereas the invention is here described in detail with reference to a presently preferred specific embodiment, it should be realized that various changes may be made without departing from the disclosed inventive concepts.

I claim:

1. An impact disintegrator for ore and rock materials, comprising walls defining a disintegration chamber; an annular grizzly within said chamber for supporting an array of closely associated chunks of impact breaking target material that are relatively large in size as compared to the size of said ore and rock material; a rotary slinger and blower disposed centrally of said chamber for forcibly throwing pieces of the ore or rock material to be disintegrated outwardly toward the grizzly, so they will strike said array of target material, and for establishing and maintaining air flow into, through, and out of said chamber to substantially immediately clear the target area of disintegrated material; means for feeding pieces of the ore or rock material into the slinger and blower; means for rotating the slinger and blower; and means for discharging from said chamber disintegrated material resulting from impact of said pieces against said array.

2. A combination according to claim 1, including, as an array of target material within the grizzly, chunk of the same ore or rock material as the pieces to be disintegrated.

3. A combination according to claim 1, wherein means are provided for bleeding off from the disintegrated ore or rock material fines carried by the air flow.

4. A combination according to claim 3, wherein the means for discharging the disintegrated material comprise chutes leading from the disintegration chamber below the grizzly; sloping ducts connecting with the chutes and leading to a central fines-collecting area; and means are provided for creating a partial vacuum in the said collecting area, ducts, chutes, and disintegration chamber.

5. A combination according to claim 1, wherein the means for removing the disintegrated material comprise chutes leading from the disintegration chamber below the grizzly.

6. A combination according to claim 5, wherein the chutes lead to a closed receiving vessel, and rupturable sleeves are attached to the lower ends of the chutes, respectively, and to the receiving vessel.

7. A combination according to claim 1, wherein the rotary slinger is horizontally disposed and comprises a pair of discs of substantially equal diameters disposed in face-to-face, mutually spaced relationship, the upper disc having a central feed opening for material to be disintegrated and a concentric air feed opening; and vanes sandwiched between said discs for slinging and blowing.

8. A combination according to claim 7, wherein the vanes include one set extending from the periphery of said discs to the central feed opening, and a second set extending from the periphery of said discs to the air feed opening, the vanes of one set alternating with the vanes of the other set.

9. A combination according to claim 7, wherein the walls defining the disintegration chamber are circumscribed by confronting walls defining a polygonal reinforcing structure; a layer of sound-deadening material is interposed between the first-named and second-named walls; a cruciform wall structure is disposed centrally of the disintegration chamber; and the means for rotating the slinger and blower include a shaft on which said slinger and blower is mounted, said shaft extending through the cruciform structure.

10. A combination according to claim 9, wherein a removable cover is provided for the disintegration chamber; a feed pipe for material to be disintegrated extends through said cover to communication with the interior of the slinger and blower through the central feed opening thereof; openings for the introduction of atmospheric air extend through said cover so as to concentrically surround said feed pipe; a circular wall concentric with said feed pipe and comprehending the air feed opening of the slinger and blower and also the air introduction openings in said cover to form a passage for air into said slinger and blower; and wherein a protective wall is provided surrounding said slinger and blower between it and said cover, said protective wall serving to removably support the passage-forming circular wall.

11. A method of disintegrating ore or rock materials, comprising the steps of feeding the material to be disintegrated to a rotary slinger within a disintegration chamber containing closely associated target chunks of impact breaking material surrounding the slinger in spaced relationship therewith, said target chunks being relatively large in size as compared to the size of said ore and rock material; slinging the material to be disintegrated against the target material surrounding said slinger in the disintegration chamber; passing a flow of air through the target area to substantially immediately clear the target area of disintegrated material, so that the particles to be disintegrated have a substantially clear path from slinger to impact surface and thereby substantially avoid collision with disintegrated particles; and discharging the disintegrated material from the disintegration chamber.

12. A method in accordance with claim 11, wherein the fines in the disintegrated material are separated from the relatively larger particles and the two are separately discharged from the disintegration chamber.

* * * * *